United States Patent [19]

Jeffrey et al.

[11] Patent Number: 4,686,449

[45] Date of Patent: Aug. 11, 1987

[54] JFET CURRENT SOURCE WITH HIGH POWER SUPPLY REJECTION

[75] Inventors: Edward N. Jeffrey; Chi-Cheong Shen, both of Richardson, Tex.

[73] Assignee: The United States of America as represented by the Secretary of the Navy, Washington, D.C.

[21] Appl. No.: 853,311

[22] Filed: Apr. 7, 1986

[51] Int. Cl.[4] ..... G05F 3/18

[52] U.S. Cl. ..... 323/231; 323/312; 323/313

[58] Field of Search ..... 323/231, 303, 312, 313; 307/297, 318, 571

[56] References Cited

U.S. PATENT DOCUMENTS 3,577,062 5/1971 Hoffman ..... 323/303

4,453,121 6/1984 Noufer ..... 323/313

FOREIGN PATENT DOCUMENTS 34342 3/1977 Japan ..... 323/231

892440 12/1981 U.S.S.R. ..... 323/231

*Primary Examiner*—William H. Beha, Jr.

*Attorney, Agent, or Firm*—Robert F. Beers; Ervin F. Johnston; Harvey Fendelman

[57] ABSTRACT

A JFET current source compensates for variations in the voltage supply to maintain a constant current level at its output terminal. Series connected diodes are used as voltage dividers in conjunction with a second JFET to establish the gate voltage of a third JFET that is connected in series with the first JFET. The constant current output is taken at the drain electrode of the third JFET.

10 Claims, 5 Drawing Figures

| VCC | iD1, D2 | IJ2 | iJ3 | EJ1 | | EJ3 | | EJ2 | | LOAD |
|---|---|---|---|---|---|---|---|---|---|---|
| | | | | Vgs | Vds | Vgs | Vds | Vgs | Vds | i |
| NOMINAL | SET SET | SET | SET | SET | SET | SET | SET | SET | SET | FIXED |
| INCREASE | NO CHANGE | NO CHANGE | NO CHANGE | NO CHG | INCR | INCR | INCR | NO CHG | INCR | NO CHG |
| DECREASE | NO CHANGE | NO CHANGE | NO CHANGE | NO CHG | DECR | DECR | DECR | NO CHG | DECR | NO CHG |

JFET CURRENT SOURCE WITH HIGH POWER SUPPLY REJECTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of precision voltage references and, more specifically, to constant current sources which may be utilized as components of precision voltage references.

High stability, precision voltage references are critical requirements in electronic designs. Reference sources are needed that have extremely low values for temperature drift, noise, internal resistance and load sensitivity combined with a high degree of short and long term stability. Such voltage references may have a wide range of applications including precision comparators, power supplies and current sources as well as analog-to-digital and digital-to-analog converter references.

The most common reference elements are diodes built to break down at a characterized voltage. Most of these reference diodes break down in what is known as the avalanche region. For example, zener diodes are typically used in this application. The temperature coefficient of the voltage in the avalanche region is positive. For a low or zero temperature coefficient reference, a forward biased diode is usually wired in series with a reverse biased zener diode. The temperature coefficient of the forward biased diode is negative and can be constructed in a way as to exactly cancel out the positive temperature coefficient drift of the avalanche diode.

The effect of neutron damage on the avalanche breakdown diode is an increase in the bias voltage with the constant bias current. Conveniently, the effect on the forward biased diode from neutron damage is opposite that of the effect on the reverse biased element. Unfortunately however, the negative change is more than that which is needed and the net result is a negative drift. With proper gold doping of the forward biased diode, the negative charge can be reduced considerably. High stability devices have been demonstrated having near zero temperature coefficients from −55° C. to 75° C. with a reference shift of 10 mV after $3\times10^{15}$N/cm$^2$ irradiation on a 6.2 $V_2$ diode.

By way of example, a precision voltage reference is disclosed in the article entitled "A Radiation Tolerant, Programmable Precision Voltage Reference", co-authored by the present inventor and Art Peltier, appearing in the 1979 issue of the Journal of the IEEE Nuclear and Space Radiation Effects Conference. The voltage reference disclosed in that article is a monolithic, integrated voltage reference consisting of five sub-circuits and including a constant current source. Reference is made to that article which is hereby incorporated by reference. The aforesaid article illustrates a suitable application for the constant current source of the present invention.

It is known that a single junction field effect transistor can be used as a current source over a wide range of voltages with a relatively constant current when biased in its saturation region. The error of this type of current source is illustrated in FIG. 1 as an upward tilt in the current characteristic, i.e. the drain current plotted as a function of drain-to-source voltage, and is due mainly to the reduction of the effective channel length because of the increased depletion layer as the gate-drain voltage ($V_{GD}$) increases.

SUMMARY OF THE INVENTION

Accordingly, the present invention is a circuit that will compensate and correct largely for the change in current with voltage that is depicted in FIG. 1. The present invention can also provide current that is over ten times more constant with voltage than the constant current that is achievable from using a standard single junction field effect transistor (JFET).

The constant current output of the present invention is accomplished by using a series connection of diodes as a voltage divider to provide a relatively constant voltage, with respect to the power supply voltage, at the gate of a second JFET that is connected in series with the first current control JFET. Simultaneously, a third JFET is connected in series with the voltage dividing diodes with its gate electrode connected between the voltage dividing diodes. The third JFET is used to provide current bias to the voltage dividing diodes. As the power supply voltage increases, for instance, the increased power supply voltage increases the gate-to-source voltage on this second JFET thereby decreasing the current through the source and drain electrodes of the second JFET. This has the net effect of compensating for the normal increase in current due to increase drain-source voltage. The resultant effect establishes a relatively constant current through the first and second JFETs.

OBJECTS OF THE INVENTION

Accordingly, it is the primary object of the present invention to disclose a novel constant current source.

It is a further object of the present invention to disclose a novel constant current source that provides a current that is over then times more constant with voltage than a standard single JFET.

It is a further object of the present invention to disclose a novel monolithic integrated constant current source.

It is a still further object of the present invention to disclose a novel constant current source that can achieve a relatively constant current varying on the order of only five microamps over a twenty-five volt, or less than 0.15%, variation in the supply voltage.

Other objects, advantages and novel features of the invention will become apparent from the following detailed description of the invention when considered in conjunction with the accompanying drawings.

DESCRIPTION OF THE PREFERRED EMBODIMENT

Figure 2:
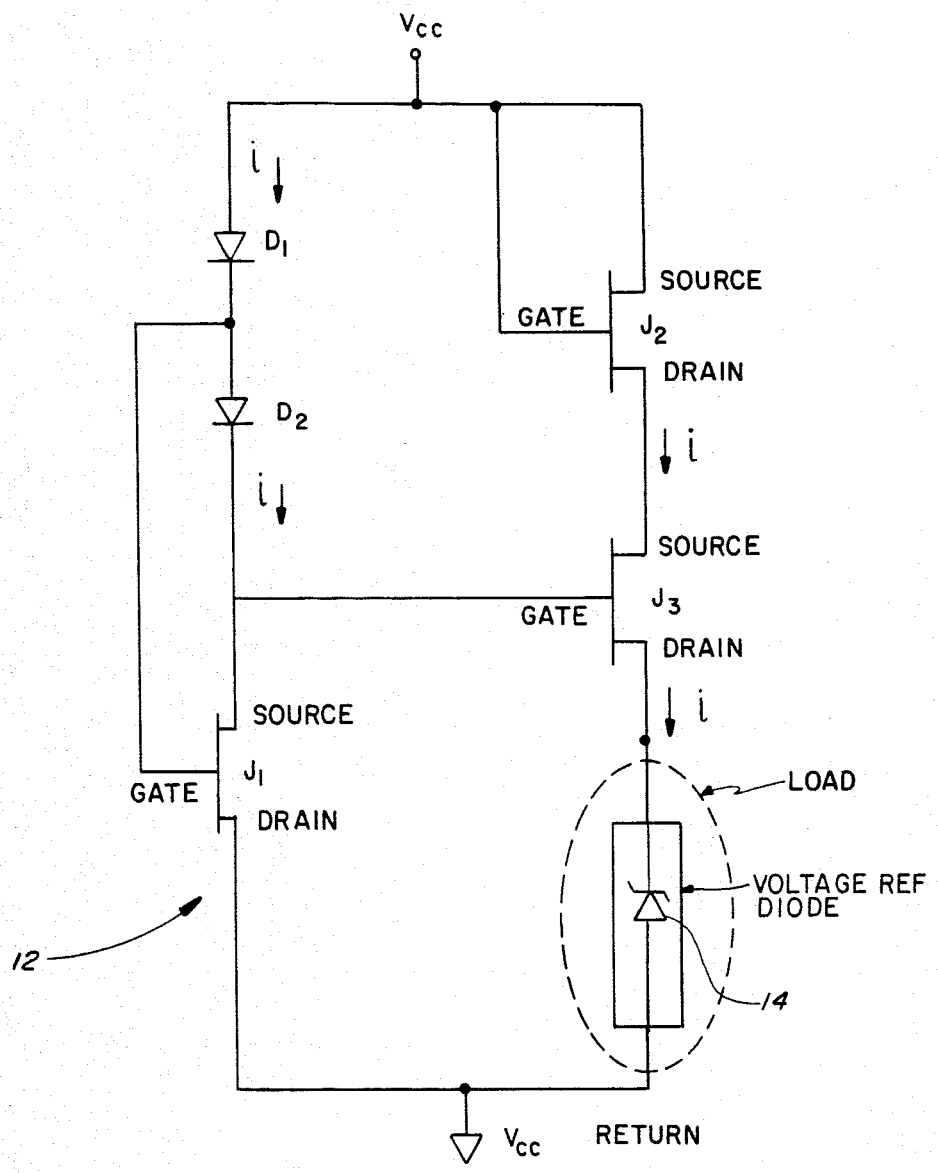
FIG. 2 is a schematic electronic diagram of the monolithic integrated constant current source of the present invention.

Referring now to FIG. 2 the circuit of the present invention will be described. The constant current source circuit 12 is made up of three P-channel, junction field effect transistors $J_1$, $J_2$, and $J_3$. The gate, source and drain of each transistor $J_1$, $J_2$, and $J_3$ is oriented as illustrated in FIG. 2. The source electrode of JFET $J_1$ is connected to the gate electrode of JFET $J_3$ and to the cathode electrode of diode $D_2$. The gate electrode of JFET $J_1$ is connected to the common electrodes of the cathode of diode $D_1$ and the anode of diode $D_2$. Diodes $D_1$ and $D_2$ are connected in series in a voltage divider arrangement as illustrated. The drain electrode of JFET $J_1$ is connected to common ground illustrated as VCC return. The anode electrode of diode $D_1$, plus the gate and source of JFET $J_2$ are connected to the voltage supply VCC. The drain electrode of JFET $J_2$ connects to the source of JFET $J_3$. At the drain of JFET $J_3$ is the negative going output current which is used to bias the voltage reference zener diode 14.

The current supplied by JFET $J_1$ is used to bias diodes $D_1$ and $D_2$. JFET $J_1$ operates with a gate-to-source voltage of about 0.7 volts or the approximate equivalent of the voltage drop across one forward biased diode such as diode $D_1$ or diode $D_2$. The two forward biased diodes $D_1$ and $D_2$ provided a relatively constant voltage at the gate of JFET $J_3$ with respect to the power supply voltage VCC of about 1.5 volts. This voltage establishes the operating voltage across the source and drain electrodes of JFET $J_2$.

Constant current supply circuit 12 of the present invention is integrated in a monolithic circuit. Therefore, the design geometries of the JFET $J_2$ and $J_3$ are assumed to be identical with matching electrical characteristics as may be presumed in integrated circuit fabrication. The voltage across the drain and source electrodes of JFET $J_2$, in the normal operation of the present invention, is maintained at a level near the minimum saturation voltage of $J_2$ which is approximately equal to the pinch-off volatage of the JFET, i.e. approximately 1.5 volts. When the power supply VCC voltage changes or, for instance, goes up, the source-to-drain voltage of JFET $J_3$ will also increase. The effective channel length of JFET $J_3$ will, in this example, decrease due to the widening depletion width, and the drain current of JFET $J_3$ will then tend to increase. At the same time, the source-drain voltage of JFET $J_2$ will increase causing the gate-to-source voltage of JFET $J_3$ to increase. At this time, JFET $J_3$ will be operating closer to the pinch-off voltage, resulting in a decrease in the drain current of $J_3$ and, in effect, compensating for the decrease in channel length. The final result is that the output current taken at the drain electrode of JFET $J_3$ is nearly independent of VCC over a wide range of voltage variation of the voltage supply VCC.

Figure 3:
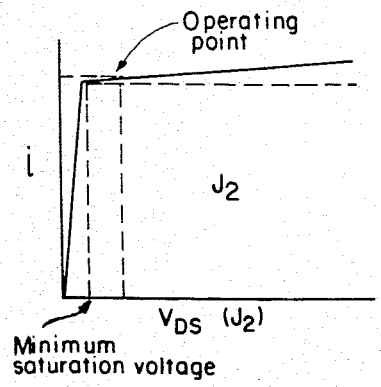
FIG. 3 is a graph of the current-voltage characteristic of the first field effect transistor of the present invention plotted in terms of current vs. drain-source voltage.
Figure 4:
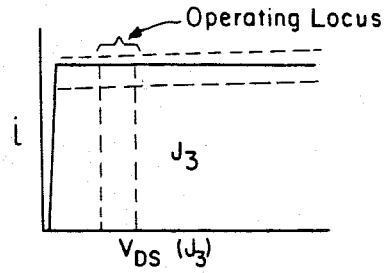
FIG. 4 is a graph of the current vs. voltage characteristic of the second field effect transistor of the present invention plotted in terms of current vs. drain-source voltage.

To assist in the understanding of the operation of circuit 12 depicted in FIG. 2, the graphs of FIGS. 3 and 4 are provided to illustrate the current characteristics of JFET $J_2$ and JFET $J_3$, respectively. Further, the chart illustrated in FIG. 5 demonstrates the effect on the current flowing through diodes $D_1$ and $D_2$, the current flowing through JFET $J_2$ and $J_3$ as well as the gate voltages and drain-to-source voltages of each of the three JFETs $J_1$, $J_2$ and $J_3$ in response to changes in the voltage level of the voltage supply VCC. The current flowing through JFET $J_2$ flows at the level indicated as "operating point"shown in FIG. 3. It should be appreciated that if JFET $J_2$ were the only device connected to the power supply VCC, then the current through $J_2$ would increase very slightly as the level of VCC increased and that as VCC decreased in amplitude, the current through $J_2$ would decrease slightly until the level of VCC reached the minimum saturation voltage point. If VCC were further decreased, the current through $J_2$ would decrease rapidly until VCC reached 0.

The purpose of JFET $J_3$ is to regulate changes occurring in the amplitude of voltage supply VCC above and below the nominal set voltage and to cause the current through JFET $J_2$ to remain fixed. JFET $J_3$ does this by gate control. More specifically, when supply VCC is increasing, the gate-to-source voltage of JFET $J_3$ is forced to increase. This, in turn, would force the current through $J_3$ to decrease if the source-to-drain voltage of $J_3$ were constant. However, an increase in the amplitude of supply VCC also causes an increase in the source-to-drain voltage across JFET $J_3$. The incremental increase of gate-to-source voltage of $J_3$ forces the current through $J_3$ to remain constant rather than increasing as it would with no change in the gate voltage. The resulting constant current through JFET $J_3$ thus also holds the current constant for the load and for JFET $J_2$.

Figures 1, 5:
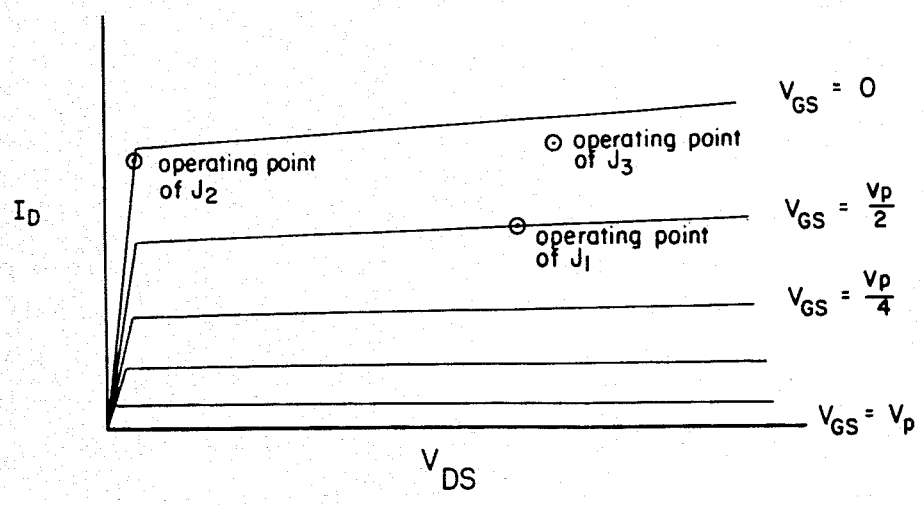
FIG. 1 is a graph of the current-voltage characteristic of a JFET plotted in terms of drain current vs. drain-to-source voltage.
FIG. 5 is a chart illustrating the effect of a change in the power supply level on the current and voltages for the various components of the present invention.

The purpose of the circuit combination of $J_1$, $D_1$, and $D_2$ is to establish a constant voltage with respect to VCC at the gate electrode of $J_3$ (Refer to FIG. 2). This is accomplished by operating $J_1$ with a gate-to-source voltage of one forward diode voltage drop (Vd) or approximately 0.75 volts. If we assume a pinch-off voltage (Vp) of 1.5 volts, then the operating point of $J_1$ is along the Vgs=Vp/2 line as depicted in FIG. 1. With a relatively constant current produced by $J_1$ to bias $D_1$ and $D_2$ in their forward direction, a reference voltage of about 1.5 volts below VCC is established at the gate electrode of $J_3$. This reference voltage establishes $J_2$'s drain-to-source voltage, Vds, operating range which is:

$$2Vd<[Vd=2]<2Vd+Vp$$

The source-drain voltage of $J_2$ will vary (increase as VCC increases) within the range as shown above. The voltage variation of $J_2$'s source-drain will be the controlling voltage ($\Delta$Vgs) of $J_3$. As VCC increases Vds of $J_2$ will tend to increase. This will cause Vgs of $J_3$ to increase (toward pinch-off) controlling $J_2$'s bias at a lower current and compensating for the normal increase in drain current, Id, with Vds as in the case with a single JFET.

Table I below illustrates the electrical measured results of the output current through transistor $J_3$ as a result in variations of the supply voltage VCC of the P-channel JFET current source illustrated in FIG. 2. As can be seen in Table I below, the current changes less than 1.5% per volt through a range of variation of the supply voltage from 10–35 volts.

TABLE I

| OUTPUT CURRENT VS VCC | |
|---|---|
| VCC (V) | I (OUTPUT) (UA) |
| 10 | 277.9 |
| 11 | 278.4 |
| 12 | 278.8 |
| 13 | 279.2 |
| 14 | 279.5 |
| 15 | 279.8 |
| 20 | 281.2 |
| 25 | 282.2 |
| 30 | 282.9 |
| 35 | 283.5 |

Obviously many modifications and variations of the present invention are possible in the light of the above teachings. It is therefore to be understood that within the scope of the appended claims the invention may be practiced otherwise than as specifically described.

What is claimed is:

1. A constant current source comprising:

a voltage source;

a first field effect transistor having a gate, a drain and a source electrode, said gate and source electrodes being connected to said voltage source;

a second field effect transistor having a gate, a drain and a source electrode, said second field effect transistor being connected to said first field effect transistor;

means connected to said first field effect transistor for detecting a change in the voltage level of said voltage source for responding thereto to change the gatesource voltage of said second field effect transistor whereby said drain electrode of said second field effect transistor has a constant current output, said means for detecting comprising:

a third field effect transistor having a gate, a drain and a source electrode; and means connected to said third field effect transistor for providing a constant voltage at said gate of said second field effect transistor.

2. The constant current source of claim 1 wherein said means for providing comprises first and second diodes connected in series and wherein said third field effect transistor gate is connected between said first and second diodes.

3. The constant current source of claim 2 further comprising:

a voltage reference connected to said drain electrode of said second field effect transistor.

4. The constant current source of claim 3 wherein: said voltage reference comprises a zener diode.

5. The constant current source of claim 4 wherein: the cathode of said zener diode is connected to said drain electrode of said second field effect transistor.

6. The constant current source of claim 1 further comprising:

a common ground terminal; and said means for detecting being connected between said first field effect transistor and said common ground terminal.

7. The constant current source of claim 1 wherein said first and second transistors are P-channel junction field effect transistors.

8. The constant current source of claim 1 wherein said source electrode of said first field effect transistor is directly connected to said voltage source.

9. The constant current source of claim 8 wherein said first field effect transistor operates near its minimum saturation voltage.

10. The constant current source of claim 9 wherein: said drain electrode of said first field effect transistor is connected to said source electrode of said second field effect transistor.

* * * * *